US006401903B1

(12) United States Patent
Berni

(10) Patent No.: US 6,401,903 B1
(45) Date of Patent: Jun. 11, 2002

(54) METHOD AND DEVICE FOR REMOVING SECTIONS FROM A STREAM OF IMBRICATED ITEMS

(75) Inventor: Claudio Berni, Hombrechtikon (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/597,641

(22) Filed: Jun. 20, 2000

(30) Foreign Application Priority Data

Jun. 23, 1999 (CH) ..... 1161/99

(51) Int. Cl.[7] ..... B65G 17/32

(52) U.S. Cl. ..... 198/370.01; 198/370.1; 198/440; 271/277

(58) Field of Search ..... 198/370.1, 370.01, 198/440; 271/277, 216, 151

(56) References Cited

U.S. PATENT DOCUMENTS

| | | | | |
|---|---|---|---|---|
| 2,861,674 A | | 11/1958 | Reist | |
| 3,722,877 A | | 3/1973 | Wetter | 270/57 |
| 3,877,564 A | | 4/1975 | Reist | 198/103 |
| 4,151,986 A | | 5/1979 | Kawada | 271/64 |
| 4,424,966 A | | 1/1984 | Chandhoke | 271/302 |
| 4,512,457 A | | 4/1985 | Reist et al. | 198/479 |
| 4,577,855 A | | 3/1986 | Reist | 271/281 |
| 4,832,327 A | * | 5/1989 | Johansson | 271/216 X |
| 5,288,067 A | * | 2/1994 | Stock | 271/216 X |
| 5,740,900 A | | 4/1998 | Cote et al. | 198/436 |
| 6,062,372 A | * | 5/2000 | Cote et al. | 198/440 |
| 6,158,735 A | * | 12/2000 | Cote et al. | 198/440 X |

FOREIGN PATENT DOCUMENTS

| | | |
|---|---|---|
| DE | 36 09 148 A1 | 10/1986 |
| DE | 84 00 542.4 | 4/1988 |
| FR | 2 420 499 | 10/1979 |

OTHER PUBLICATIONS

WO 99/30997, Pulbication Date: Jun. 24, 1999, Clamp for Holding Flat Objects.

* cited by examiner

*Primary Examiner*—Joseph D. Pape
*Assistant Examiner*—Lori L Coletta
(74) *Attorney, Agent, or Firm*—Rankin, Hill, Porter & Clark LLP

(57) ABSTRACT

From a scaled stream (2) which is conveyed along a first conveying path (F.1) through a removal region (A) in a held manner, the held conveyance is deactivated at the entrance of the removal region (A) for stream sections which are to be removed from the scaled stream or from which items are to be removed and the sections or items to be removed are conveyed by means of a second conveying means (5) being adjustable for a removal onto a second conveying path (P.2), while for the rest of the stream sections (2.1) the held conveyance is maintained during conveyance through the removal region (A). The first conveying means (1) e.g. comprises clamping elements for gripping e.g. the longitudinal edges of the scaled stream (2), the clamping elements being opened selectively at the entrance of removal region (A). The second conveying means (5) e.g. comprises a pivoting conveying belt (5.2) on which stream sections (2.2) to be removed are conveyed onto the second conveying path (F.2) in a loosely laying manner.

15 Claims, 6 Drawing Sheets

METHOD AND DEVICE FOR REMOVING SECTIONS FROM A STREAM OF IMBRICATED ITEMS

BACKGROUND OF THE INVENTION

The invention is generally directed toward conveyance of streams of imbricated flat items, of so called scaled streams, i.e. conveyance of a large number of flat items such as printed products like newspapers or magazines arranged in line and partly overlapping in conveying direction. The method and device according to the invention serve for removing sections, individual items or groups of successive items, from such scaled streams.

Scaled streams such as, for example, laid out by rotation printing machines are a commonly used conveying formation and are also used in intermediate storing during further processing of printed products (e.g. intermediate storage of printed products in scaled formations wound up in rolls). Scaled streams of printed products or of other flat items are typically conveyed laying loosely on conveying supports such as conveying belts. For sections of a conveying distance, wherein due to a too steep gradient, conveyance of the loose formation is not possible, double belts are provided between which the scaled stream is held.

For longer conveying distances on complicated courses (gradients, curves, turns) usually the conveying means are equipped with holding means for holding a scaled stream from moving laterally or in any other direction. For this kind of held conveyance of a scaled stream clamping devices arranged on a transport device (e.g. transport chain) are applicable. Depending on the stiffness of the items forming the scaled stream, depending on the course of the conveying line and depending on the demand on the conveyance, the scaled stream is held on one side only or on both sides.

The distance between single clamping elements along the scaled stream is to be chosen such that each item in the scaled stream is held by at least one clamping element. If each item is held by more than one clamping element, the scaled stream forms a coherent belt. If each item is held by one clamping element, only the scaled stream actually consists of sections, whereby each section comprises a plurality of items and is held by one clamping element.

Conveying means equipped with holding means and suitable for conveying scaled streams are described in U.S. Pat. Nos. 2,861,674, 3,877,564 and 4,512,457.

A plurality of known methods are applied for removing individual items or groups of successive items from a loose scaled stream. From a scaled stream with the downstream edges of the product positioned on the upper side of the stream a single item is removed, for example, by gripping the downstream edge and pulling the item out of the stream by accelerating it. This kind of removal is described in the publication EP-0116015 (U.S. Pat. No. 4,577,855, F153). For removal of groups of successive items, the scaled stream is divided at the end of a pivoting part of the conveying support and the pivoting part of the conveying support is pivoted upwards and downwards in order to be connected to a farther conveying means for conveying away the stream section to be removed from the scaled stream. Once the section to be removed has passed the pivoting part of the conveying support, the scaled stream is divided again and the conveying support is pivoted back.

SUMMARY OF THE INVENTION

It is an object of the invention to create a method and a device that allow removal of sections from scaled streams being held during conveyance. According to the present invention, an effect of the removal on the held conveyance of the stream parts not being removed is prevented as far as possible and the method is to be able to be carried out with a simple device.

According to the inventive method, the scaled stream being conveyed in a held manner is conveyed through a removal region, whereby the held conveyance for stream sections not to be removed remains largely unchanged. For sections that are to be removed completely or from which items are to be removed, the holding means is deactivated, whereby such sections are freed from the hold of the holding means and become removable.

The device for carrying out the inventive method comprises a conveying means (first conveying means) for conveying the scaled stream in a held manner. This first conveying means is designed for conveying the scaled stream through a removing region on a first conveying path. At the entrance of the removing region, controlling means are arranged for a controlled de-activation of the holding means. The device further comprises a second conveying means that is arranged on the first conveying path (parallel to the first conveying means) at the entrance to the removal region. The second conveying means is driven in synchrony with the first conveying means and within the removal region being adjustable for either conveying on the first conveying path or for conveying on a second conveying path leading away from the first conveying path.

The second conveying means is designed for interaction with a different part of the items in the scaled stream than the part being acted on by the holding means of the first conveying means. The second conveying means is equipped for conveying a scaled stream either loosely or held.

BRIEF DESCRIPTION OF THE DRAWINGS

These and further features of the invention will be apparent with reference to the following description and drawings, wherein:

FIG. 1 illustrates conveyance of stream sections on a first part of the first conveying path. FIG. 2 illustrates conveyance of a section to be removed from the scaled stream from the first to the second conveying path. Both FIGS. 1 and 2 have a side views above and a top view therebelow;

DETAILED DESCRIPTION OF THE PREFERRED EMBODIMENTS

Figure 1:
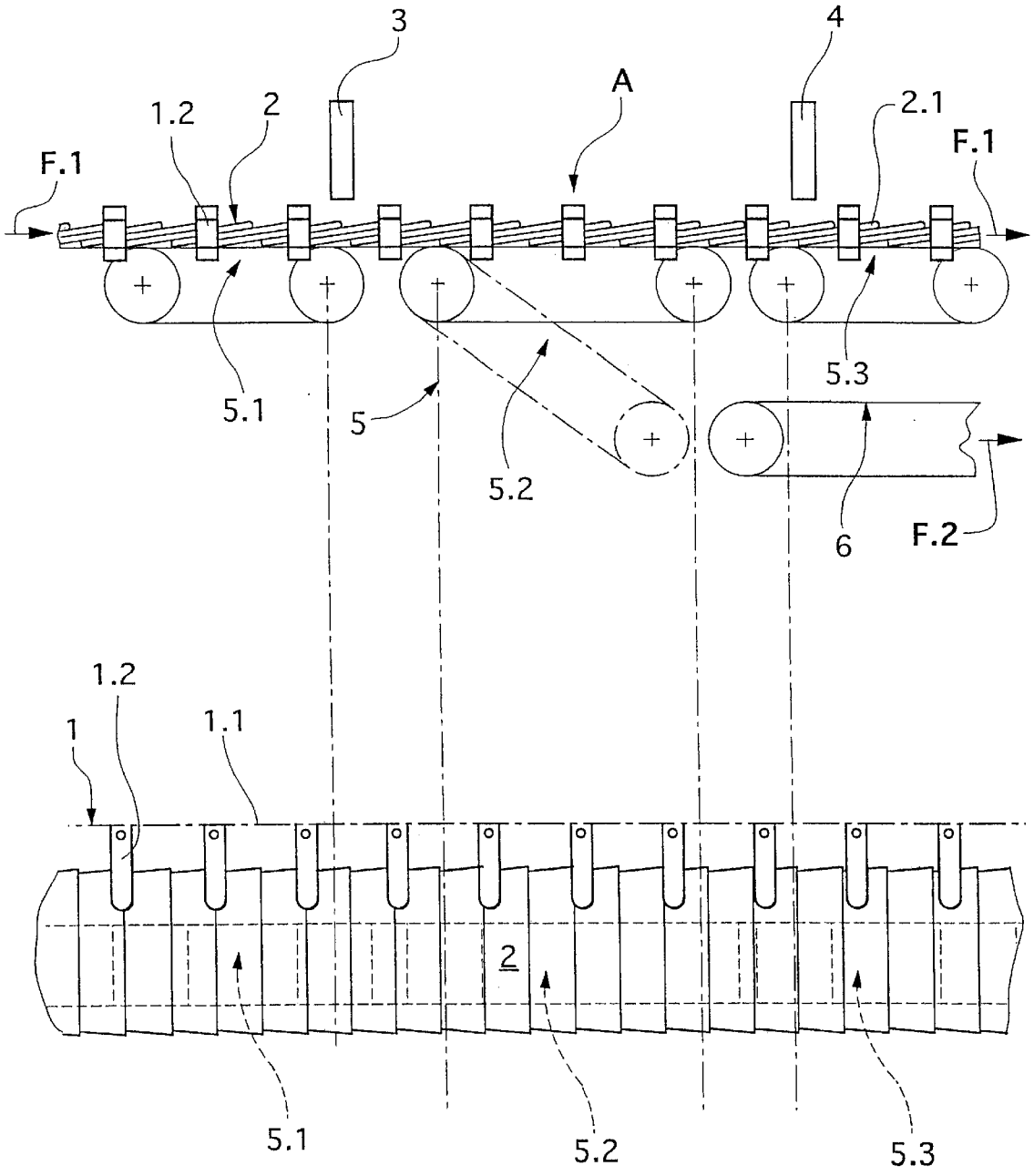
FIGS. 1 and 2 show the conveyance of a scaled stream in the removal region of an exemplified embodiment of the device for carrying out the inventive method.
Figure 2:
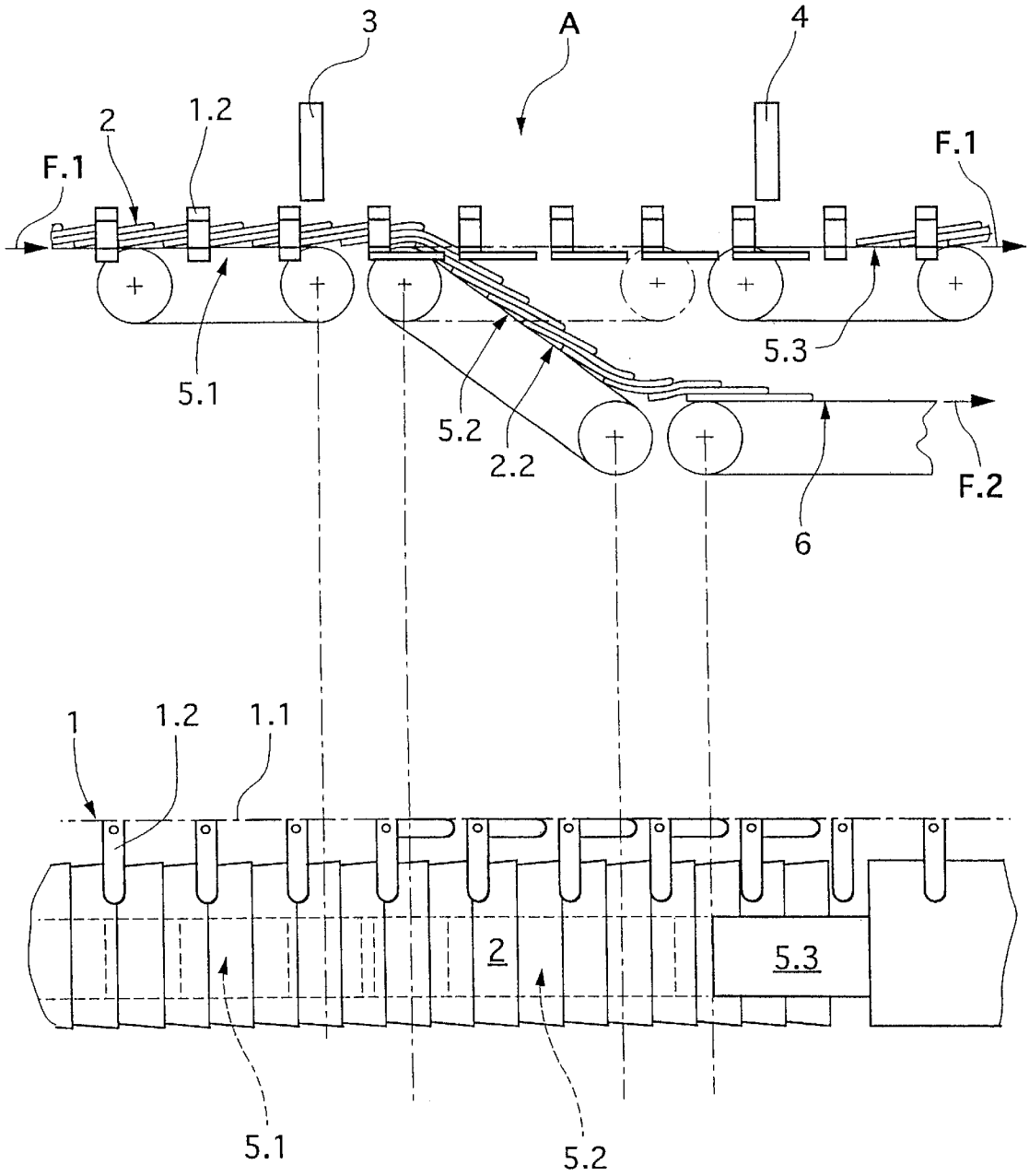

FIGS. 1 and 2 show very diagrammatically the removal region A of an exemplified embodiment of the device for carrying out the inventive method, in a side view above and in a top view below. The removal region is a kind of switch point to which the scaled stream is fed on the first conveying path F.1 and from which sections (2.1, 2.2) are either conveyed further on the first conveying path F.1 (FIG. 1) or are diverted onto a second conveying path F.2 (FIG. 2).

A first conveying means 1 serves for conveying the scaled stream 2 in a held manner on the first conveying path F.1 to the conveying region A. The conveying means 1 also serves for conveying sections 2.1 of the stream, which are not to be removed, further on the first conveying path F.1 still in a held manner. In the shown embodiment, the first conveying means 1 consists of a transport means 1.1 (e.g. pushed or drawn transport chain or individual transport elements) and clamping elements 1.2, each having a pair of clamping jaws. Control means 3 arranged at the entrance of the removal region selectively deactivate the clamping elements 1.2 by bringing them from a clamping configuration into a non-clamping configuration. Control means 4 at the exit of the removal region reactivate deactivated clamping elements by bringing them from a non-clamping configuration into a clamping configuration.

A second conveying means 5 is arranged in the removal region A and is adjustable for removal. The second conveying means 5 consists, in the illustrated embodiment, of a series of three conveying belts 5.1, 5.2, and 5.3. The first conveying belt 5.1 is arranged on the entrance side and aligned with the first conveying path F.1. The second conveying belt 5.2 is adjustable in a position aligned with the first conveying path for non-removal or pivoted towards the second conveying path F.2 for removal. The third conveying belt 5.3 is arranged on the exit side and aligned with the second conveying path. For conveying away removed sections of the scaled stream a conveying-away means 6, such as a further conveying belt, is provided. The conveying belts 5.1, 5.2 and 5.3 of the second conveying means 5 are narrower than the scaled stream 2 and act on a bottom side of the scaled stream. In other words, the conveying belts 5.1, 5.2, 5.3 act in a region of the items in the stream not acted on by the clamping elements 1.2 of the first conveying means 1.

FIG. 1 shows the device during conveyance of a stream section 2.1 not to be removed, i.e. conveyance of a stream section on the first conveying course F.1 through the removal region. Neither the control means 3 at the entrance, nor the control means 4 at the exit are active. The clamping elements 1.2 remain in the clamping configuration during conveyance through the removal region A. The second conveying means 5, in particular pivoting conveying belt 5.2, is adjusted to be aligned with the first conveying path F.1. The conveying speed of the second conveying means 5 is the same as the conveying speed of the first conveying means 1.

FIG. 2 shows, in the same manner as FIG. 1, conveyance of a stream section 2.2 downwards and away from the first conveying path course F.1 to the second conveying path F.2. Along this section the clamping elements 1.2 are deactivated by entrance control means 3. This means for the illustrated embodiment that the pair of clamping jaws of the corresponding clamping elements is opened for ending the clamping effect (lower clamping jaw moved downwards) and enabling a release of the items in a downwards direction the lower clamping jaws are swiveled away. Downstream of the entrance control means 3, the stream section 2.2 to be removed is conveyed only by the second conveying means 5. The stream section 2.2 lays loosely on the conveying belts 5.1 and 5.2 and is guided to conveying-away means 6 by the conveying belt 5.2 which is pivoted downwards (adjusted for removal).

The conditions for acting on the scaled stream and for conveying speeds to be fulfilled by the second conveying means 5 are not valid for the conveying-away means 6. The conveying-away means 6 may be wider than the scaled stream 2 and may act on its bottom side over its whole width and it may be driven slower or faster than the first conveying means (1 and 5) and, therefore, will compress or lengthen the removed stream section 2.2.

As is known from removing sections of scaled streams being conveyed in a loosely laying formation, the scaled stream, as is illustrated in FIGS. 1 and 2, is divided at locations between a section to be removed and a section not to be removed. Accordingly, corresponding stream dividing means are provided.

The control means 3 at the entrance to the removal region is triggered such that all clamping elements 1.2 acting on stream parts containing sections or single items to be removed are deactivated while other clamping elements pass the control means in clamping configuration. At the exit of the removal region A the clamping elements 1.2 may be brought into a clamping configuration again by the exit control means 4. Due to this reactivation of the clamping elements 1.2, the downstream and upstream parts of sections not to be removed can possibly be stabilized. The reactivation of the clamping devices 1.2 at the exit of the removal region is, however, not a condition for the inventive method.

The second conveying means 5 plays an irrelevant role on conveyance along the first conveying path F.1 (FIG. 1). In this configuration the second conveying means could also be absent. If, however, it is present and active, it is important that it has the same conveying speed as the first conveying means 1. It is possible to do without the entrance-side conveying belt 5.1 and/or the exit-side conveying belt 5.3 as long as the entrance control means 3 and the exit control means 4 are arranged immediately upstream and downstream of the pivoting conveying belt 5.2.

In FIGS. 1 and 2 removing stream sections in a downward direction is shown. In an analogue manner removal in an upward direction can be realized, whereby the upper clamping jaws are be swiveled away on de-activating the clamping elements. Removal regions in which the second conveying path connects in a straight line to the first conveying path and the first conveying path turns off upwards or downwards can be realized in analogue manner.

Figure 3:
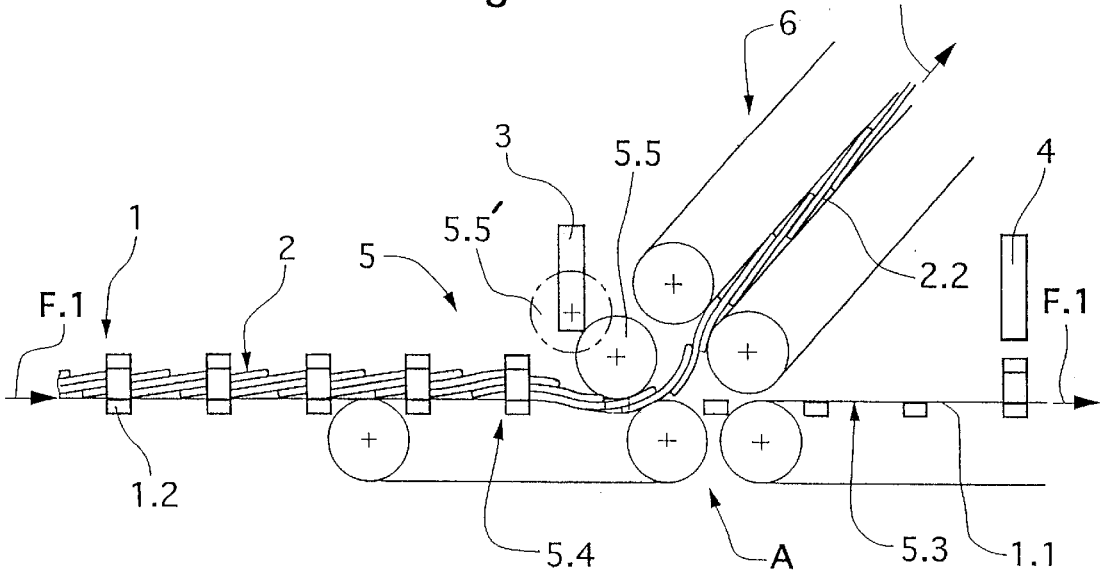
FIGS. 3 and 4 show two further removal regions of exemplified embodiments of the device for carrying out the inventive method.

FIG. 3 shows a further exemplified embodiment of the device for carrying out the inventive method in a side view and in a phase in which a stream section to be removed is conveyed through the removal region A. First conveying means 1 lead through the shown removal region A, which defines a first conveying path F.1, and is equipped with clamping elements 1.2 for held conveyance of the scaled stream 2. The second conveying means 5 is adjustable for removal and comprises a stationary conveying belt 5. 4 (or other deformable conveying support) aligned with the first conveying path F.1 and driven in synchronism with the first conveying means 1. It further comprises an adjustable excursion roll 5.5, which has a removal position (shown in unbroken lines and designated 5.5) and a resting position (shown in broken lines and designated 5.5'). The entrance control means 3 is positioned upstream of the excursion roll 5.5 and the exit control means 4 is positioned downstream of the excursion roll 5.5.

For a stream section to be to be removed or for a section containing items to be removed, the clamping elements 1.2 of the first conveying means are deactivated by the entrance control means. The excursion roll 5.5 positioned in its removal position presses against the stationary conveying belt 5.4. The items of the scaled stream are bent and their downstream edges, which are positioned on the top side of the stream are gripped by the conveying-away means 6. The conveying-away means comprises a pair of belts pressed against each other and driven in opposite directions.

For stream parts from which no items are to be removed, the entrance control means is not active and the excursion roll is in its resting position (5.5'). In other words, the scaled stream 2 is conveyed into the removal region A, through the removal region A, and out of the removal region A on the first conveying path without change of the held configuration.

Figure 4:
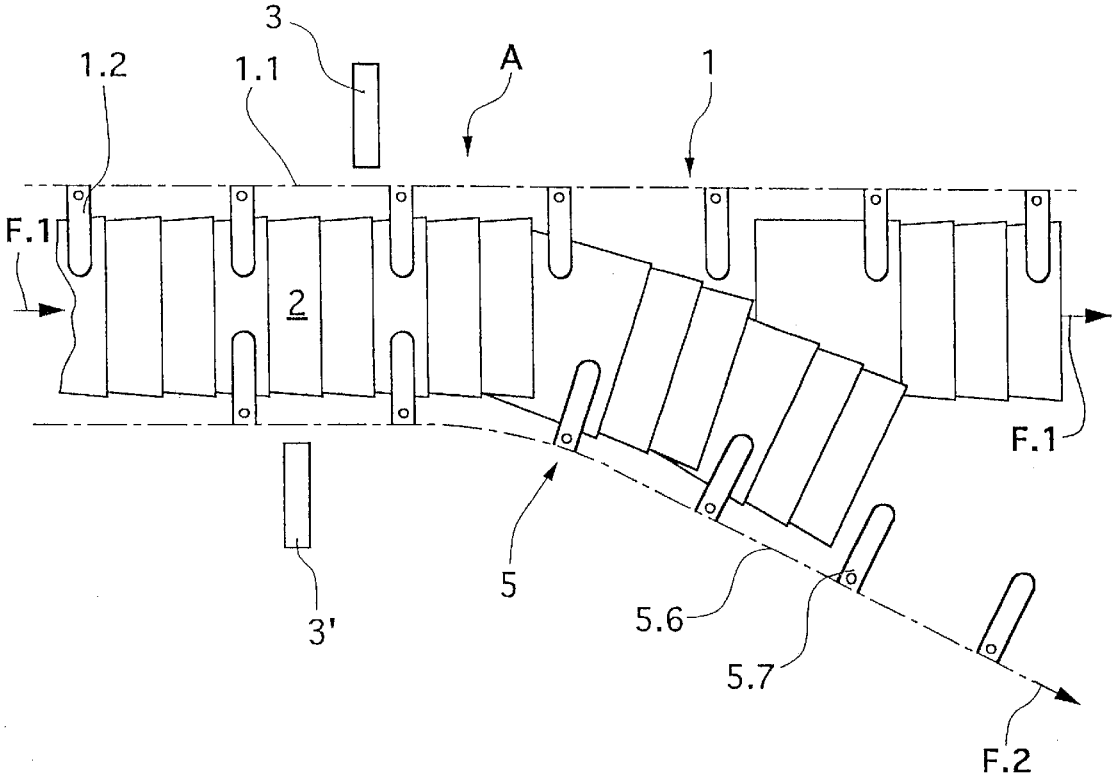

FIG. 4 shows, in a top view a further exemplified embodiment of the device for carrying out the inventive method. Again, a removal region is shown with a first conveying path F.1 and a second conveying path F.2. A first conveying means 1 provides held conveyance of the scaled stream 2 along the first conveying path F.1. A second conveying means 5 is adjustable for removal. For this embodiment the second conveying means 5 is designed in the same manner as the first conveying means 1. Accordingly, the second conveying means 5 includes a transport means 5.6 and clamping elements 5.7 arranged on the transport means. The distances between the clamping elements 5.7 and 1.2 are identical and matched to the scaled stream 2 such that each item in the scaled stream is only held by one clamping element. The scaled stream consists of a plurality of sections, each section comprising a plurality of items all being held by one clamping element.

At the entrance of removal region A the first and second conveying means run in parallel and in synchronism. An entrance control means 3 for deactivating clamping elements 1.2 is provided for the first conveying means. Upstream of entrance control means 3, an entrance control means 3' for activating clamping elements 5.7 of the second conveying means 5 is provided. The first conveying means 1 leaves the removal region A on the first conveying path F.1 and the second conveying means 5 on the second conveying path F.2. Therefore, the second conveying means 5 also takes over the function of the conveying-away means (6 in FIGS. 1 to 3).

For adjusting the second conveying means for removal, the entrance control means 3' allocated to this conveying means is made active for moving the clamping jaws of the clamping devices 5.7 into a clamping position. At the same time the entrance control means 3 allocated to the first conveying means 1 is activated for moving the damping jaws of the clamping elements 1.2 into a non-clamping configuration. With such configuration of the clamping elements, the scaled stream is conveyed onto the second conveying path.

With a removal, as is shown in FIG. 4, stream sections are removed in parallel to the width of the scaled stream. For this reason it is sufficient to open the clamping elements 1.2 of the first conveying means 1. No clamping jaws must be removed from an area above and below the scaled stream 2, as is the case in the method described in connection with FIGS. 1 to 3.

The two conveying means 1 and 5 in a removal region A, as shown in FIG. 4, can define, within wide limits, almost any form of path and the spatial position of the scaled stream can be of almost any description. The only condition is at least a punctual parallelism at the entrance of removal region A and synchronous operation.

If, as shown in FIG. 4, the first and second conveying means 1 and 5 have clamping elements distanced from each other such that at least part of the items in the stream are held by more than one clamping element or a further conveying means like a conveying belt, is to be provided. The clamping elements 1.2 of the first conveying means 1 are then to be deactivated further upstream than the clamping elements 5.7 of the second conveying means 5 and the scaled stream is conveyed between deactivation and activation by the further conveying means, e.g. in a loosely laying manner.

FIGS. 5 to 9 show examples of transport means with clamping elements and their application as first conveying means 1 for held conveyance of scaled streams. The angle of view in all these Figures is parallel to the first conveying path.

Figure 5:
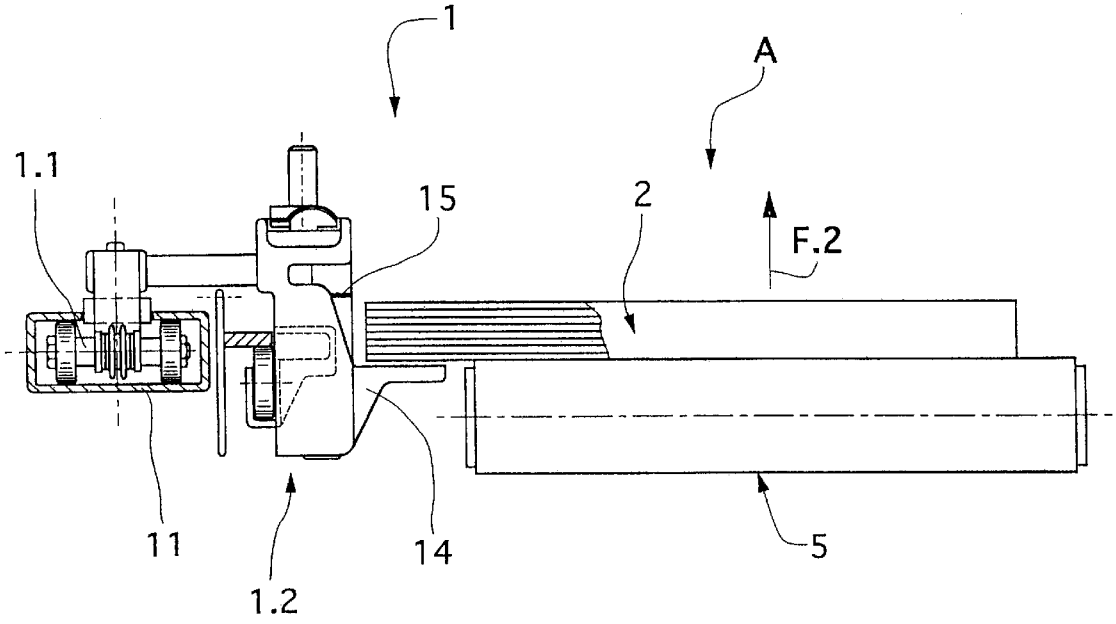
FIGS. 5 to 9 show different examples of clamping elements applicable in a device for carrying out the inventive method.
Figure 6:
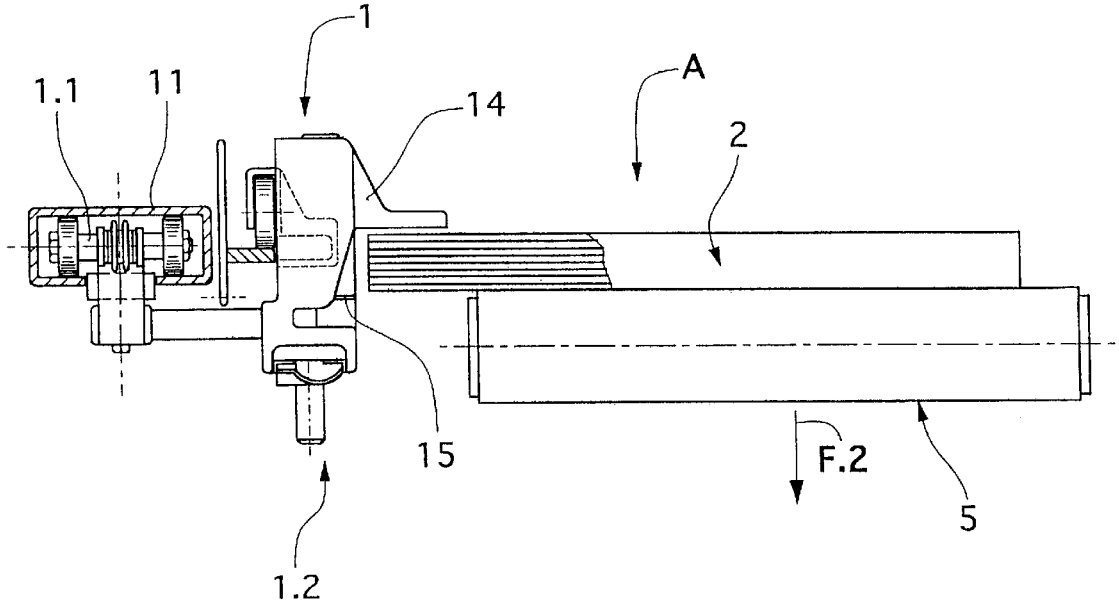

FIGS. 5 and 6 show a first conveying means 1 and a second conveying means 5 in a removal region A. The first conveying means 1 comprises a transport means 1.1, which is, for example, designed as a pull chain running in a channel 11 and clamping elements 1.2 with a stationary clamping jaw 14 each and a clamping jaw 15 which can be swiveled away from the scaled stream 2. The clamping elements 1.2 are shown in their deactivated, non-clamping configuration in which clamping jaw 15 is swiveled outwards. This means that the scaled stream 2 is conveyed by the second conveying means 5 (conveying belt).

The means for held conveyance of a scaled stream as shown in FIGS. 5 and 6 as well as control means for deactivation/activation are described in detail in the publication EP-0095602. Of course, this kind of conveying means can also be arranged on both sides of the scaled stream 2 and the pair of conveying means can serve as first conveying means. The same conveying means with clamping elements can also serve as second conveying means in a method as shown in FIG. 4.

FIG. 5 shows an arrangement for removal of sections from a scaled stream in an upward direction in which arrangement the clamping elements 1.2 are designed such that the upper clamping devices can be swiveled out of the region of the scaled stream. FIG. 6 shows an arrangement for removal of sections from a scaled stream in a downward direction, in which the clamping elements are designed such that the lower clamping jaws can be swiveled out of the region of the scaled stream.

Figure 7:
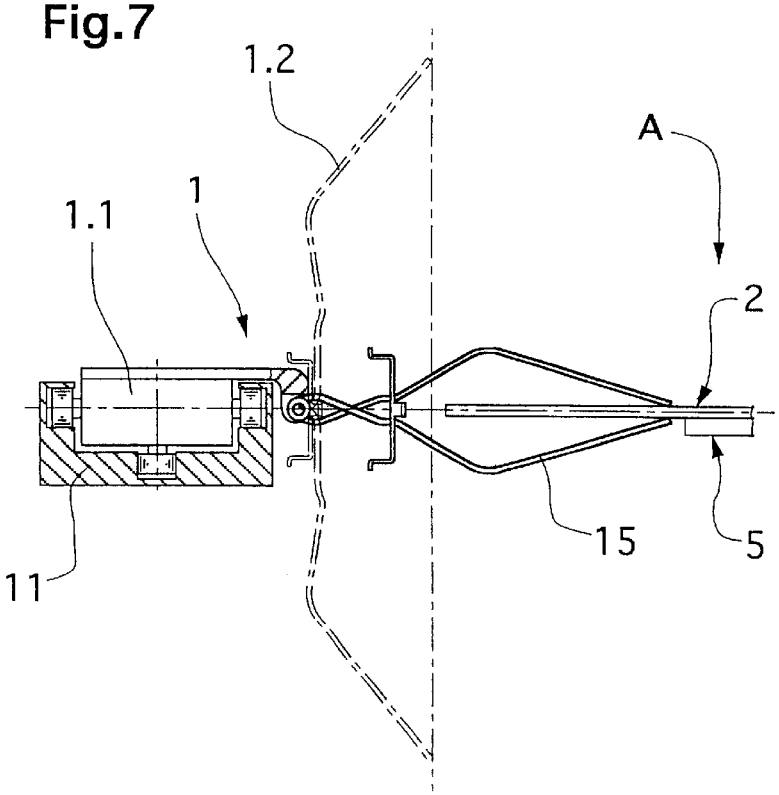
Figure 8:
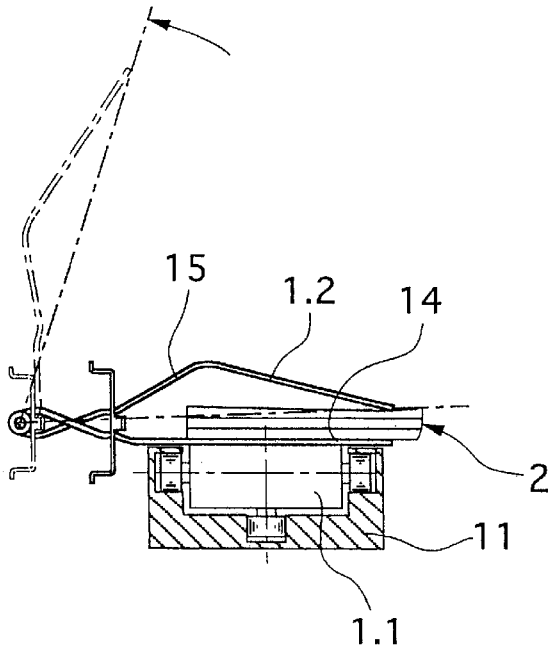
Figure 9:
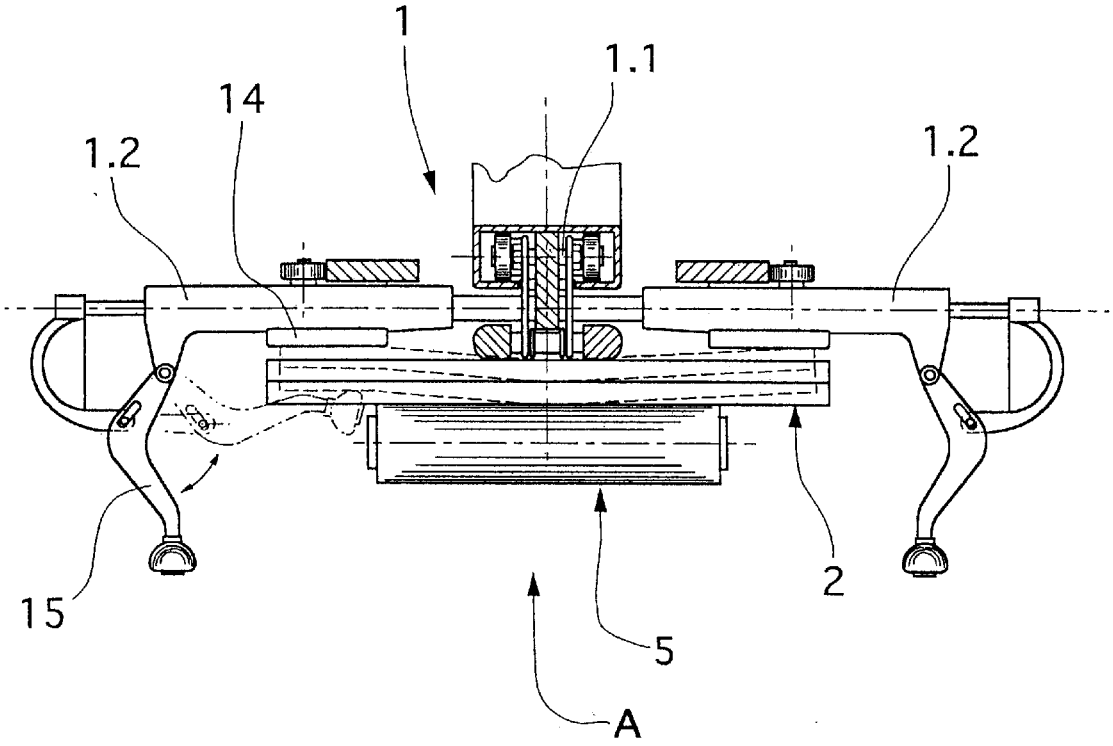

FIGS. 7 and 8 show, in the same manner as FIGS. 5 and 6, first conveying means with a transport means 1.1 and clamping elements 1.2 in a removal region A. The parts are marked with the same reference numerals as in FIGS. 5 and 6. The shown clamping elements 1.2 and control means for their deactivation/activation are described in detail in the patent application CH-2901/97.

The clamping element according to FIG. 7 has two clamping jaws 15 which can be swiveled out of the region of the scaled stream 2 and, for this reason, it is suitable for arrangements with removal regions in which sections are removed in an upward and/or downward direction.

FIG. 9 again shows, in the same manner as FIGS. 5 and 6, a first conveying means 1 and a second conveying means 5 in a removal region. The first conveying means 1 comprises clamping elements 1.2 acting on the scaled stream on both sides and having clamping jaws 15 which can be swiveled out of the region of the scaled stream. The second conveying means 5 is again designed as a conveying belt. The clamping elements 1.2 and control devices for their deactivation/activation are described in detail in the publication CH-559692.

What is claimed is:

1. Method for removing individual items or groups of items from a scaled stream (2) consisting of a line of flat items overlapping each other like scales and being conveyed in a held manner along a first conveying path (F.1), characterized in that the scaled stream (2) is held for held conveyance in a region of at least one longitudinal edge of the scaled stream with the aid of clamping elements (1.2), and wherein, at the entrance of a removal region (A) arranged along the first conveying path, for stream sections (2.2) which are to be removed from the stream or from which items are to be removed, the held conveyance is deactivated, opening the clamping elements (1.2), and the items to be removed are conveyed from the first conveying path (F.1) onto a second conveying path (F.2) and that the remaining sections (2.1) are conveyed through the removal region (A) in an unchanged held manner along the first conveying path, (F.1).

2. Method according to claim 1, characterized in that the clamping elements (1.2) are opened in a manner to, free an area below or above the scaled stream (2).

3. Method according to claim 2, characterized in that sections (2.2) to be removed from the scaled stream (2) are removed in a direction perpendicular to the width of the scaled stream.

4. Method according to claim 3, characterized in that sections (2.2) which are to be removed from the scaled stream or from which items are to be removed are conveyed through the removal region (A) in a loose manner, i.e. without being held.

5. Method according to claim 1, wherein section (2.2) to be removed from the scaled stream are removed in a direction parallel to the width of the scaled stream.

6. Method according to claim 5, characterized in that sections to be removed from the scaled stream are conveyed through the removal region (A) in a held manner.

7. Method according to claim 1, wherein the flat items are printed products.

8. A device for removing individual items or groups of items from a scaled stream (2) consisting of a line of flat items overlapping each other like scales and being conveyed in a held manner along a first conveying path (F.1), said device comprising: a first conveying means (1) with holding means for held conveyance of a scaled stream (2) along the first conveying path (F.1), the device further comprises an entrance control means (3) for the selective deactivation of the holding means of the first conveying means (1), the entrance control means being arranged at the entrance of a removal region (A) being passed by the first conveying means (1), as well as a second conveying means (5) being adjustable for the removal and being, at the entrance to the removal region (A), aligned with the first conveying path (F.1) and in the removal region (A) being adjustable for conveyance on the first conveying path (F.1) or for conveyance from the first conveying path (F.1) onto the second conveying path (F.2), wherein the holding means of the first conveying means (1) holds the scaled stream (2) in a first region and the second conveying means (5) acts on the scaled stream in a second region different form the first region and wherein the first and the second conveying means (1 and 5) are driven in synchronism.

9. Device according to claim 8, characterized in that the first conveying means (1) comprises a transport means (1.1) and clamping elements (1.2) arranged on the transport means (1.1) and being designed for lateral clamping of the scaled stream (2), which clamping elements (1.2) are opened for deactivation.

10. Device according to claim 9, characterized in that for removing sections (2.2) from the scaled stream in a direction perpendicular to the width of the scaled stream, parts of the clamping devices (1.2) are removable from a region above and/or below the scaled stream.

11. Device according to claim 10, characterized in that the second conveying means (5) comprises a pivoting conveying belt (5.4).

12. Device according to claim 10, characterized in that the second conveying means (5) comprises an excursion roller (5.5) and a deformable conveying support (5.4) cooperating with the excursion roller.

13. Device according to claim 8, wherein the second conveying means (5) comprises holding means for held conveyance of stream sections (2.2) and heat for adjusting the second conveying means (5) for removal, an entrance control means (3') allocated to the second conveying means (5) and being equipped for bringing the holding means into a holding configuration is provided at the entrance of the removal region (A).

14. Device according to claim 13, characterized in that the holding means of the second conveying means (5) is a plurality of clamping elements (5.7) arranged on a transport means (5.6) and that the clamping elements (5.7) are closed on activation.

15. Device according to claim 8, wherein, at the exit of the removal region (A). an exit control means (4) for reactivation of the holding means of the first conveying means (1) is provided.

* * * * *